United States Patent [19]

Henk

[11] Patent Number: 4,501,659

[45] Date of Patent: Feb. 26, 1985

[54] SKIMMER APPARATUS FOR SWIMMING POOLS

[76] Inventor: Charles R. Henk, 581 Princeton Ave., Brick Town, N.J. 08723

[21] Appl. No.: 447,512

[22] Filed: Dec. 7, 1982

[51] Int. Cl.[3] ..... E04H 3/16

[52] U.S. Cl. ..... 210/169; 210/416.2; 417/87; 417/90; 417/160

[58] Field of Search ..... 210/169, 416.2, 416.1; 417/90, 87, 181, 103; 261/DIG. 75; 15/1.7; 4/488, 490, 507, 512, 509, 510

[56] References Cited

U.S. PATENT DOCUMENTS

| | | | |
|---|---|---|---|
| 1,157,692 | 10/1915 | Hayes | 417/103 |
| 3,444,575 | 5/1969 | Martin | 15/1.7 |
| 3,444,584 | 5/1969 | Cote | 15/344 |
| 3,551,930 | 1/1971 | Myers | 15/1.7 |
| 3,701,427 | 10/1972 | Howard | 210/169 |
| 4,154,679 | 5/1979 | Farage | 210/169 |

*Primary Examiner*—Richard V. Fisher
*Assistant Examiner*—Sharon T. Cohen
*Attorney, Agent, or Firm*—Dann, Dorfman, Herrell and Skillman

[57] ABSTRACT

Skimmer apparatus for swimming pools and the like having a receptacle in which a skimmer basket is fitted. The receptacle provides a chamber into which pool water flows through the skimmer. Water is caused to flow into and through the receptacle by a connection within the receptacle to the makup water inlet of the pool. The inlet water discharging into the pool through the chamber of the receptacle and the flow of the water by an ejector effect causing flow through the receptacle thereby causing a substantial amount of the pool water to be recirculated through the receptacle although it is not recirculated through the conventional pool suction pump and inlet which operates to supply the inlet water pressure for activating the skimmer apparatus. Several embodiments are illustrated including an embodiment in which the skimmer is mounted in a flotation receiver which floats on the water to maintain the open end of the receiver just below the level of the water in the pool to insure that the water recirculated through the receiver is drawn from the surface level of the pool.

14 Claims, 7 Drawing Figures

SKIMMER APPARATUS FOR SWIMMING POOLS

FIELD OF THE INVENTION

The present invention relates to swimming pools and more particularly to apparatus for removing solid material which falls into and is suspended in the pool water.

BACKGROUND OF THE INVENTION

Pools are conventionally equipped with a filter and recirculating pump which operates to withdraw pool water from the pool through a suction port and pump it through a filtering apparatus prior to returning the water to the pool through a makeup water inlet. The suction port is conventionally incorporated within a skimmer assembly which draws pool water into a skimmer basket which collects debris and other solid material which is suspended in the pool water. Smaller particles are free to pass through the skimmer basket and are removed by the filtration apparatus. The suction port in the skimmer is normally effective to draw in surface water within a radius of three to four feet of the skimmer opening and the water inlet to the pool is designed to cause the water to circulate through the pool so that material floating on the surface will pass within the orbit of influence of the skimmer. Solid materials which are not drawn into the skimmer continue to float suspended within the pool and eventually settle to the bottom of the pool where they are removed by periodic vacuuming or other bottom-cleaning techniques.

If the pool is located in an area where there is a large quantity of falling leaves, or other debris which falls into the pool, the pool water must be continuously recirculated and when the pool is in use it may be necessary to periodically skim the foreign materials, such as leaves and the like, from the pool surface manually. Furthermore, the slow removal of the foreign material tends to allow the settlement and accumulation of dirt or other solid material which does not readily float within the pool requiring frequent bottom cleaning.

SUMMARY OF THE PRESENT INVENTION

The present invention provides an improved apparatus for maintaining the cleanliness of the pool. In particular the present invention provides means for removing solid material which is suspended in the pool by an action similar to the skimming action, but with a greater intensity so that the cleansing operation is effective for a substantially greater area than the conventional skimmer. The apparatus employs the existing water circulation devices of the pool and is readily applied to preexisting pools without substantial expense. The device is also capable of being incorporated into new pool construction.

The present invention provides a receiver for collecting the solid material which is suspended in the water caused to circulate through the skimmer apparatus of the present invention and the effectiveness of the skimming operation is substantially enhanced by providing an increased flow through the skimmer apparatus while using the output from the standard pool filter pump as an ejector.

More specifically the present invention provides a receptacle which accommodates the receiver or filter basket of the apparatus, the receptacle having an outlet opening through which water may flow from the receptacle into the pool. The circulation through the receptacle is produced by a connection to the inlet from the pool filter pump which is effective to direct the discharge from the pool filter pump through the outlet opening, the outlet opening being sufficiently larger than the discharge stream from the pool filter pump to generate a substantially increased flow from the receptacle which is greater than the flow from the inlet.

The present invention provides a skimming apparatus which is fully effective in operation is easily maintained, and is installed at minimum expense.

BRIEF DESCRIPTION OF THE DRAWINGS

The objectives of the invention and the detailed operation of the preferred embodiments of the invention will be better understood with reference to the accompanying drawings in which.

DESCRIPTION OF THE PREFERRED EMBODIMENTS

Figure 1:
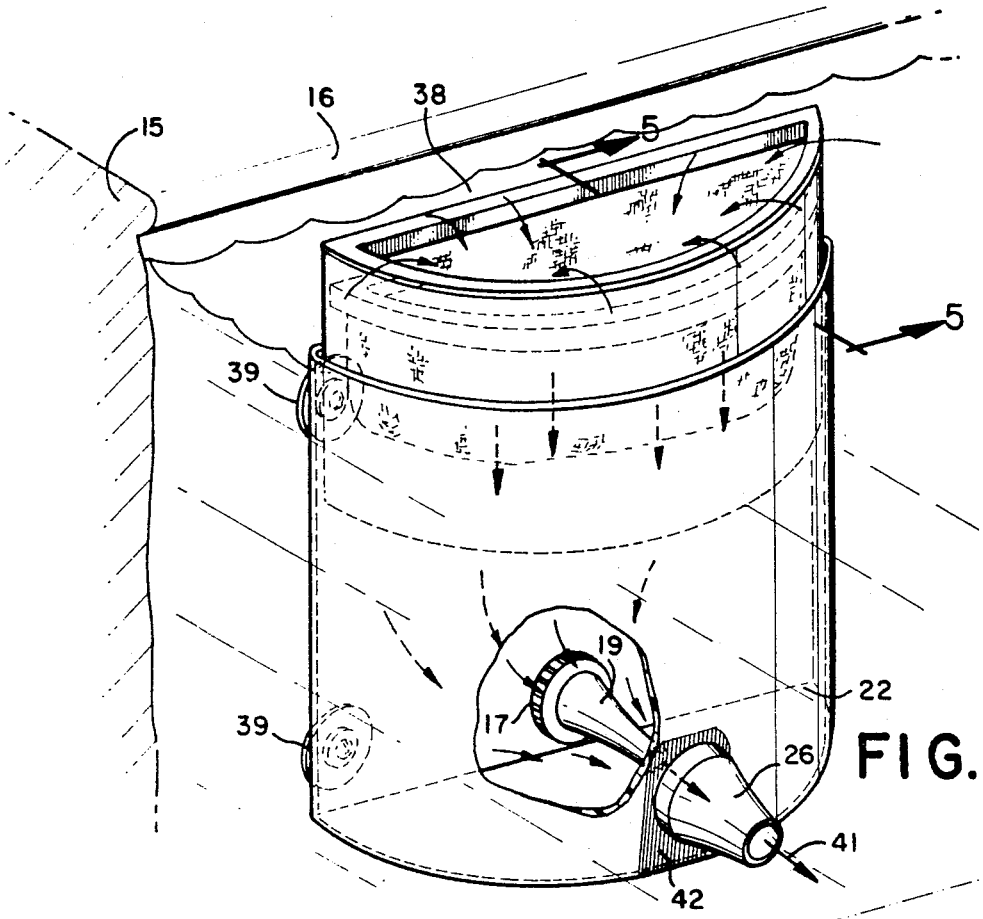
FIG. 1 is a perspective view of a skimming apparatus embodying the present invention.

Referring now to FIG. 1, the skimmer apparatus illustrated in FIG. 1 is designed to be mounted on the side of the pool at the point where the inlet from the pool filter pump is positioned. In the illustrated embodiment, the pool is shown with a solid wall 15 having conventional coping 16. The makeup water inlet 17 is positioned in the side 15 somewhat below the coping 16 and conventionally consists of an internally threaded pipe 18 which is adapted to receive a nozzle assembly 19 adapted to interact with the skimmer apparatus of the present invention.

Figure 4:
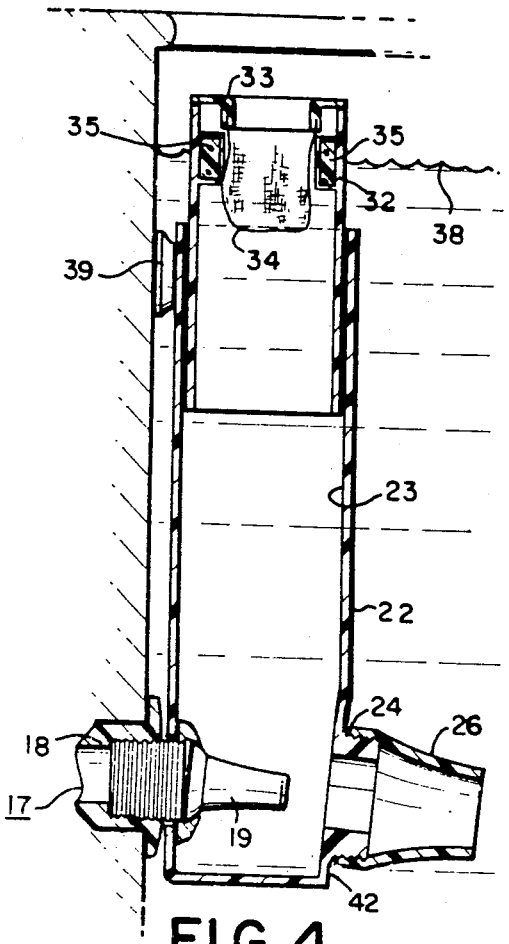
FIG. 4 is a vertical section through the apparatus shown in FIG. 1 when at rest without any flow from the inlet from the pool filter pump.
Figure 5:
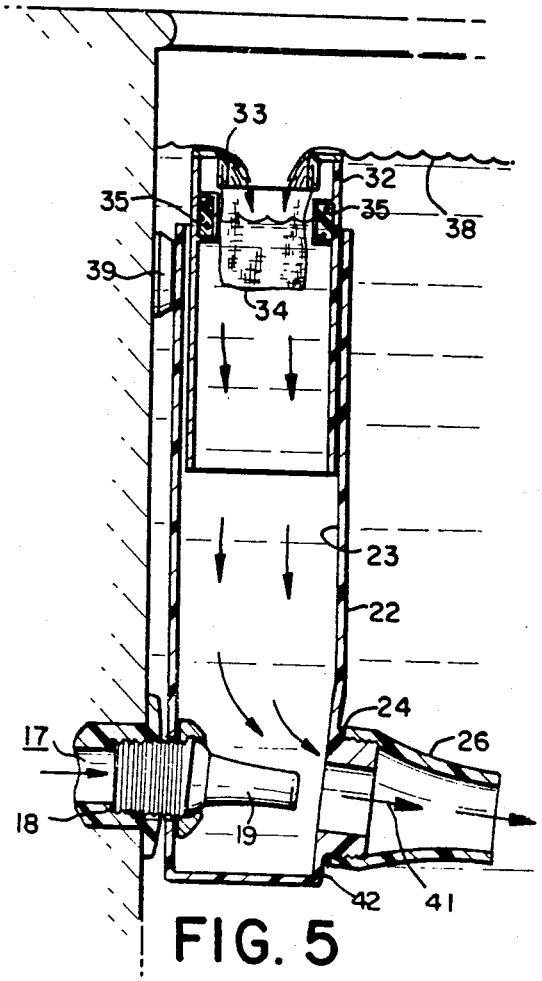
FIG. 5 is a view similar to FIG. 4 and taken on the line 5—5 of FIG. 1 showing the position of the elements when the pool filter pump is operative to discharge a stream of water through the inlet.

In accordance with the invention, a tubular receptacle 22 is mounted on the side 15 of the pool in a position so that the nozzle assembly 19 may project into the hollow interior of the receptacle. The receptacle 22 is closed at the bottom and is open at the top, and as shown in FIG. 1 is bowed outwardly into the body of the pool by a generally arcuate outer wall. The arcuate outer wall and the flat inner wall cooperate to define between them a chamber 23 which is open at the top and has an outlet opening 24 directed into the body of water in the pool adjacent the bottom of the receptacle. In the present instance, the opening 24 is fitted with a directional spout 26. A tubular receiver 32 is mounted for telescoping vertical engagement in the open top of the receptacle 22 and is freely slidable within the open top of the receptacle. As shown in FIGS. 4 and 5, the top and bottom of the receiver 32 are open and a strainer basket 33 is fitted into the top of the receiver 32 providing a foraminous portion 34 below the top of the receiver 32 in which foreign material may collect.

As shown in FIG. 4, the walls of the receiver 32 are imperforate and a flotation ring 35 is mounted on the interior wall surrounding the receiver at a position spaced below the top of the receiver. The flotation ring 35 is secured inside the wall so that it is responsive to the level of the water within the receiver and may move the receiver up and down as the water level within the receiver rises and falls. The imperforate walls of the receiver 32 therefore isolate the interior chamber 23 of the receiver and receptacle from the body of water in the pool outside the receiver and receptacle, forming an auxiliary space within the hollow interior of the receptacle. Under static conditions with no flow through the inlet 17, the water level within the auxiliary space 23 finds the level of the body of pool water outside of the receiver and receptacle by reason of the communication afforded through the discharge opening 24. Upon activation of the inlet 17, the inlet nozzle 19 directs the makeup water from the inlet 17 outwardly through the discharge opening 24 and the spout 26, the internal cross section of the opening and spout being sufficiently greater than the cross section of the nozzle 19 so that the dynamic flow of the stream of water from the nozzle 19, by ejector effect, causes evacuation of the chamber 23 through the outlet spout 26, lowering the water level within the chamber 23 as shown in FIG. 5. The lowering of the water level internally of the receiver 32 causes the receiver 32 to fall within the receptacle so that the top of the receiver 32 falls below the water level 38 within the body of water in the pool and the water spills over the top of the receiver 32 into the strainer basket 33 and is drawn through the foraminous portion 34 into the chamber 23 and is ejected into the pool through the spout 26, any foreign particles suspended within the water falling over the top of the receiver 32 being entrapped by the foraminous portion 34.

The receptacle 22 is mounted in the pool by reason of the aperture in its interior wall which fits over the nozzle 19 which cooperates with the inlet to provide vertical support for the receptacle on the wall 15 of the pool. Lateral support for the receptacle is provided by bumper elements 39 positioned on the inner wall of the receptacle and adapted to engage the side wall of the pool. In the present instance the bumper elements 39 comprise elastomeric suction cups positioned at the four corners of the interior wall of the receptacle 22. Thus the receptacle may be mounted in an existing pool by simply engaging the opening in the interior wall over the nozzle, putting the proper nozzle fittings in place to anchor the receptacle 22.

The nozzle 19 of the embodiment shown in FIGS. 1, 4 and 5 is preferably elongated to provide a jet or stream of fluid 41 which is projected through the spout 26 along its central axis. To assure alignment of the jet 41 with the central axis of the spout 26, the nozzle 19 is adjustably mounted in its fitting so that the angularity corresponds to the downward inclination of the spout 26 which results from the sloping land portion 42 in the central bottom portion of the arcuate outer wall of the receptacle 22. The downward direction of the spout 26 causes a desirable circulation of water within the body of the pool and this direction may be modified by substituting different spout configurations, as desired. Thus the embodiment of FIGS. 1, 4 and 5 provides an effective skimming apparatus which utilizes existing structures of the pool and may be fabricated simply and inexpensively and installed without use of skilled labor.

Figure 2:
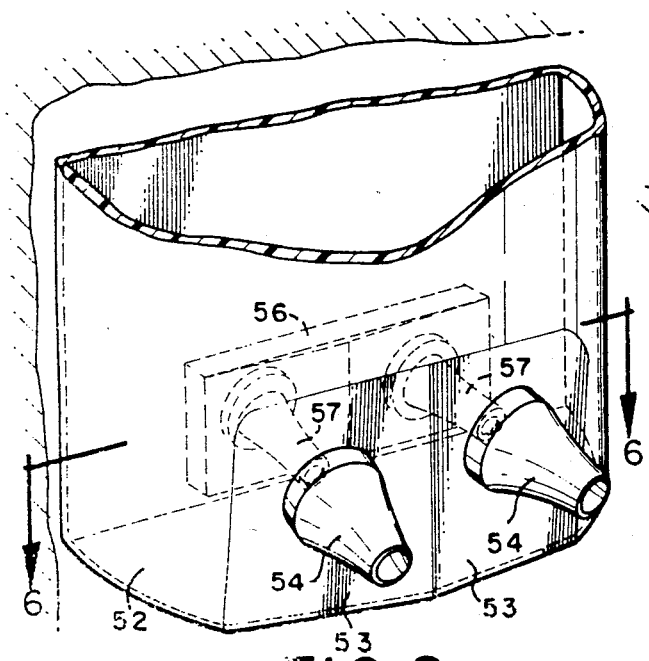
FIG. 2 is a fragmentary view of the lower portion of an alternative embodiment of the skimming apparatus shown in FIG. 1.
Figure 6:
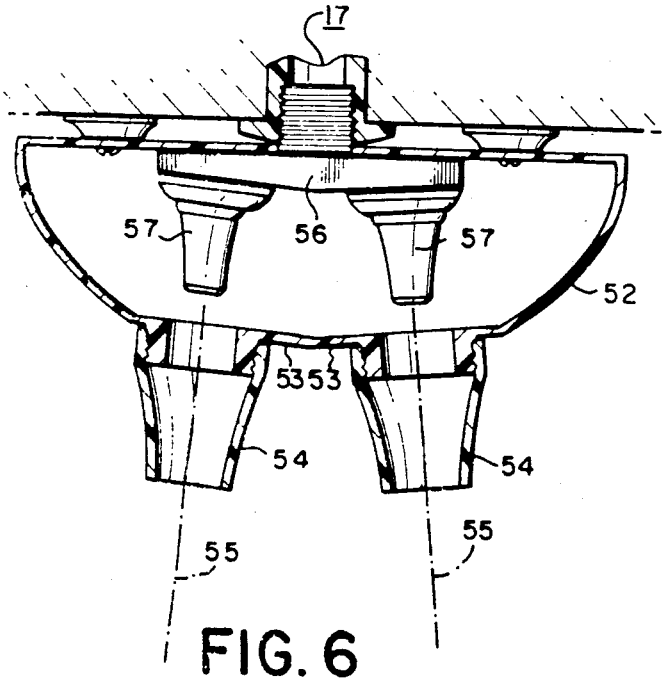
FIG. 6 is a horizontal section taken on the line 6—6 of FIG. 2.

In larger pools, it may be desired to provide different flow circulation from the receptacle spout, and to this end a modified embodiment is shown in FIGS. 2 and 6 wherein the receptacle 52 has a double land area 53 centrally disposed on its outer arcuate wall as shown in FIG. 2. Each part of the land area 53 is provided with a downwardly and outwardly directed spout 54 which, as shown in FIG. 6 have divergent axes 55,55. In order to provide an ejector effect through the spouts 54,54 the inlet 17 of the pool is equipped with a manifold 56 having a pair of nozzles 57,57 which are aligned with the axes 55,55 of the spouts 54,54. Thus in the embodiment shown in FIGS. 2 and 6 the skimming apparatus is effective to provide a different circulating path within the body of the water in the pool, as desired. As with the previous embodiment, the direction of the circulation may be modified by substitution of different spouts.

Figure 3:
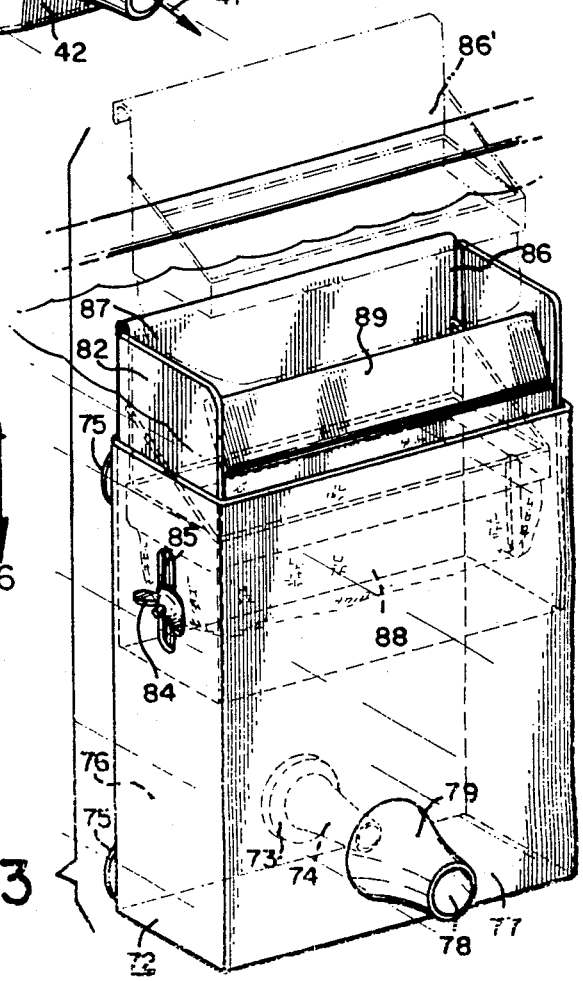
FIG. 3 is a perspective view of another embodiment of the skimming apparatus of the present invention.

Another embodiment of the invention is illustrated in FIG. 3. In this embodiment of the invention the receiver for debris and other solid material is adjustably mounted in the open top of the receptacle. As shown in FIG. 3, a tubular receptacle 72 is mounted on the inlet 73 by an inlet nozzle 74 which fastens the receptacle 72 to the wall of the swimming pool. The receptacle is positioned against the wall by bumper element 75. The receptacle comprises an open-topped rectangular structure having a closed bottom and parallel inner and outer walls 76 and 77, the outer wall 77 having a discharge opening 78 with a directional spout 79 in alignment with the nozzle 74 of the inlet. A receiver 82 is fitted in the open upper end of the receptacle and comprises a similar rectangular tubular framework which is open at the top and bottom. The receiver structure 82 is adjustably mounted on the receptacle 72 by wing nuts 84 passing through slots 85 in the side walls of the receptacle. The outer wall of the receiver has a flapper valve 89 at its upper end to prevent solid materials from floating out of the receiver when flow through the nozzle 74 is arrested.

Adjustment of the receiver 82 enables the open top and valve of the receiver to be positioned below the normal water level in the pool. The receiver 82 includes a removable foraminous structure 86 which in the present instance comprises a basket element having a back portion 87 with a reversely turned lip at its top to hook onto the top of the receiver 82. The back plate 87 of the removable basket portion 86 supports a foraminous portion 88 which, when in place as shown in full lines in FIG. 3, spans between the front and back wall of the receiver to separate any solid materials from the water flowing through the receiver.

The embodiment of the invention shown in FIG. 3 functions like the previously-described embodiments. The water flowing into the pool through the nozzle 74 is expelled through the outlet opening 78 and because of the relative dimensions of the nozzle 74 and the outlet spout 78, a large quantity of water is drawn from the receptacle and is ejected with the makeup water passing through the nozzle 74. The flow of water through the receptacle causes the surface water from the pool to overflow into the receptacle trapping any solid materials on the foraminous portion 88 of the receiver. As shown in FIG. 3, the nozzle 74 and the spout 78 have their axes aligned in a horizontal plane. If found desirable to cause the water discharge from the receptacle to flow downwardly, deflectors may be provided or a different spout may be applied.

As shown in FIG. 3, the receiver framework 82 determines the degree to which the open top is below the surface level of the water in the pool, and the foraminous portion 88 of the basket 86 is readily removable from the receiver 82 by removing the basket as indicated in broken lines at 86' in FIG. 3.

Figure 7:
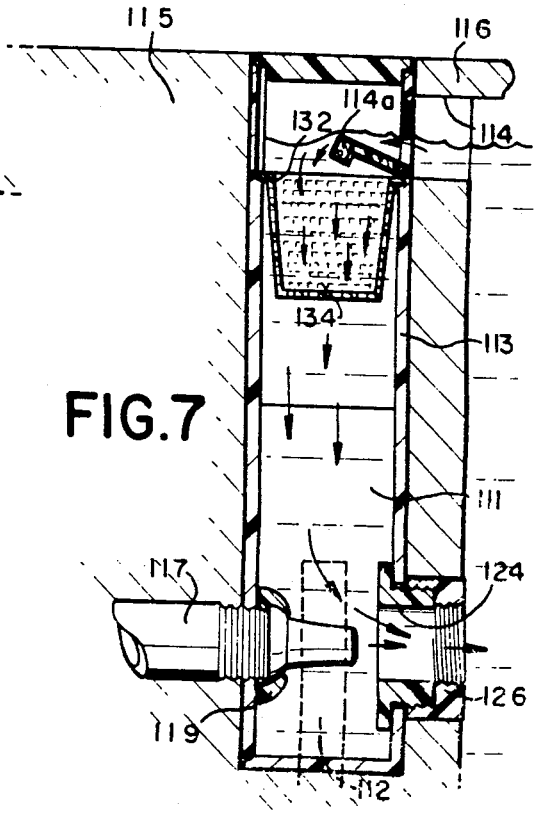
FIG. 7 is a sectional view of an alternative embodiment in which the skimmer apparatus is built integrally into the pool wall.

The present invention is not limited to skimming apparatus applied to preexisting pools, but also may be applied to pools during the original construction. An appropriate built-in structure is shown in FIG. 7. In this figure, the pool wall 115 has a coping 116 which is interrupted to provide a port 114 for the skimming operation. The usual flapper valve 114*a* is positioned in the port 114. In the present instance the skimming apparatus is embodied in a casing 113 which is embedded in the wall structure 115, the casing incorporating the usual makeup water inlet 117 and the suction port 112 which leads to the pool filter pump and serves to recirculate water from the pool through the filter pump and filter back to the inlet 117. The inlet 117 and the exhaust port 112 both open into the casing 113 and to minimize adverse influence of one upon the other, a baffle partition 111 is positioned between the inlet 117 and the suction 112. As an alternative, the suction port and the inlet may be in entirely separate chambers.

It will be apparent that the casing 113 may serve the function of the receptacles 22, 42 and 72 described above. The inlet 117 has a nozzle portion 119 directed across receptacle casing 113 in alignment with an outlet opening 124 in the opposite wall of the casing. The opening 124 is provided with a fitting 126 providing a outlet passageway having an axis aligned with the axis of the nozzle 119. The fitting 126 extends through the wall 115 of the pool and may be provided at the wall surface with a suitable directional spout as desired (not shown). The flow passage through the fitting 126 and the spout must be sufficiently greater than the flow passage through the nozzle 119 to enable the stream from the nozzle 119 to eject water from the receptacle formed by the casing 113 and cause the substantial flow providing an enlarged radius of effectiveness through the skimmer opening 114. The top of the casing 113 is open to the skimmer opening 114 and a receiver 132 is fitted in the top of the casing 113. In the present instance the receiver 132 is in the form of a basket having a depending foraminous portion 134 which serves to collect solid materials suspended in the water flowing into the casing 113 from the pool. The built-in skimming apparatus of FIG. 7 operates like the previously-described embodiments and a detailed discussion of the operation is not deemed necessary.

While particular embodiments of the present invention have been herein illustrated and described it is not intended to limit the invention to such disclosures, but changes and modifications may be made therein and thereto within the scope of the following claims.

I claim:

1. For a swimming pool having a body of water and a water inlet for introducing make-up water into said body to maintain a normal surface level, a skimmer apparatus for collecting solid materials suspended in said body comprising a receiver having an open top and a foraminous portion below said open top, means to support said receiver with its open top adjacent the surface level of the body of water, a receptacle in fluid communication with said foraminous portion of said receiver, means defining a discharge opening in said receptacle for directing water from said receptacle into the body of water, and nozzle means adapted to be connected to said water inlet and positioned in registry with said discharge opening to direct a stream of the make-up water from the inlet through said discharge opening, said opening being sufficiently larger than said nozzle stream to cause said nozzle to eject water from said receptacle through said outlet along with the make-up water, the ejection of water from said receptacle causing pool water to flow into the open top of said receiver and through the foraminous portion, solid material in the pool water being trapped in said receptacle by said foraminous portion.

2. A skimmer apparatus according to claim 1 including adjustable means cooperable with said support means to adjustably mount the receiver in said receptacle to position the open top of the receiver at a preselected level in the pool.

3. A skimmer apparatus according to claim 1 wherein said receptacle is tubular in form and is open at the top below the surface of the body, and said receiver having the foraminous portion removably mounted therein to afford displacement of said portion to enable emptying solid material trapped therein.

4. A skimmer apparatus according to claim 1 wherein said receiver telescopically engages the receptacle and is freely movable within the top thereof, said receiver including flotation means operable to maintain the top of the receiver at a predetermined distance from the surface level of the body of water.

5. A skimmer apparatus according to claim 4 wherein the upper portion of said receiver is imperforate and said flotation means maintains the top of the receiver above the surface level of the water supporting said flotation means, so that the upper portion of said receiver defines an auxiliary space for the water inside the receiver and receptacle separate from the body of water outside the receiver and receptacle, the flow of water through said discharge opening causing the water in said auxiliary space to assume a level below the surface level of the body outside the receiver and receptacle, said flotation means being supported by the water in said auxiliary space.

6. A skimmer apparatus according to claim 1 wherein said discharge opening comprises a tapered tubular spout projecting from said receptacle at its lower end, said nozzle means having a discharge axis aligned with the central axis of said spout.

7. A skimmer apparatus according to claim 6 wherein said spout is directed to discharge water downwardly toward the bottom of the pool.

8. A skimmer apparatus according to claim 1 wherein said discharge opening comprises a pair of elongated spouts, each having a central axis, said nozzle means comprising a pair of nozzles and a manifold adapted for connecting said nozzles to the water inlet, the axis of each nozzle being aligned with the axis of one of said pair of spouts and axially spaced therefrom to afford ejection of water from said receptacle.

9. A skimmer apparatus according to claim 8 wherein each spout of the pair of spouts has an axis directed downwardly toward the bottom of said pool, the axes of said pair diverging from each other in the direction away from said receptacle.

10. A skimmer apparatus according to claim 1, said support means including a coupling adapted for attaching said receptacle to the inlet and means to engage the pool and position the receptacle therein.

11. A skimmer apparatus according to claim 10 wherein said positioning means comprises bumper elements in the form of elastomeric suction cups.

12. A skimmer apparatus according to claim 11 wherein the swimming pool has a rigid wall with the inlet mounted integrally within said rigid wall, said coupling means being adapted for vertically supporting said receptacle on the rigid wall and said bumper elements being adapted for laterally supporting said receptacle on the rigid wall.

13. In combination with a swimming pool having a rigid wall for containing a body of water and a water inlet for introducing make-up water into said body to maintain a normal surface level, a skimmer apparatus for collecting solid materials suspended in the body of water comprising a receiver having an open top and a foraminous portion below said open top, means to support said receiver with its open top adjacent the surface level of the body of water, a receptacle mounted integrally within said rigid wall in fluid communication with said foraminous portion of said receiver, means defining a discharge opening in said receptacle for directing water from said receptacle into said body, said make-up water inlet being positioned within said receptacle to introduce make-up water into the body of water through said receptacle and said discharge opening, and nozzle means connected to said water inlet and positioned in registry with said discharge opening to direct a stream of make-up water from said inlet through said discharge opening, said opening being sufficiently larger than said nozzle stream to cause said nozzle to eject water from said receptacle through said outlet along with the make-up water, the ejection of water from said receptacle causing pool water to flow into the open top of said receiver and through the foraminous portion, solid material in the pool water being trapped in said receptacle by said foraminous portion.

14. A combination according to claim 13 including pump means connected to said water inlet, wherein said receptacle includes a return compartment having a suction port cooperating with said pump means to recirculate water from the pool through said suction port to said make-up water inlet.

* * * * *

REEXAMINATION CERTIFICATE (573rd)

United States Patent [19]

Henk

[11] B1 4,501,659

[45] Certificate Issued Sep. 23, 1986

[54] SKIMMER APPARATUS FOR SWIMMING POOLS

[76] Inventor: Charles R. Henk, 581 Princeton Ave., Brick Town, N.J. 08723

Reexamination Request:
No. 90/000,910, Nov. 21, 1985

Reexamination Certificate for:

| | |
|---|---|
| Patent No.: | **4,501,659** |
| Issued: | **Feb. 26, 1985** |
| Appl. No.: | **447,512** |
| Filed: | **Dec. 7, 1982** |

[51] Int. Cl.[4] ..... E04H 3/16

[52] U.S. Cl. ..... 210/169; 210/416.2; 417/87; 417/90; 417/160

[58] Field of Search ..... 210/169, 416.2,. 416.1; 417/90, 87, 181; 261/DIG. 75; 15/1.7; 4/488, 490, 507, 512, 509, 510

[56] References Cited

U.S. PATENT DOCUMENTS

| | | | |
|---|---|---|---|
| 3,372,809 | 3/1968 | Spitzer | 210/169 |
| 3,928,202 | 12/1975 | Raubenheimer | 210/169 |

*Primary Examiner*—A. H. Metz
*Attorney, Agent, or Firm*—Dann, Dorfman, Herrell and Skillman

[57] ABSTRACT

Skimmer apparatus for swimming pools and the like having a receptacle in which a skimmer basket is fitted. The receptacle provides a chamber into which pool water flows through the skimmer. Water is caused to flow into and through the receptacle by a connection within the receptacle to the makup water inlet of the pool. The inlet water discharging into the pool through the chamber of the receptacle and the flow of the water by an ejector effect causing flow through the receptacle thereby causing a substantial amount of the pool water to be recirculated through the receptacle although it is not recirculated through the conventional pool suction pump and inlet which operates to supply the inlet water pressure for activating the skimmer apparatus. Several embodiments are illustrated including an embodiment in which the skimmer is mounted in a flotation receiver which floats on the water to maintain the open end of the receiver just below the level of the water in the pool to insure that the water recirculated through the receiver is drawn from the surface level of the pool.

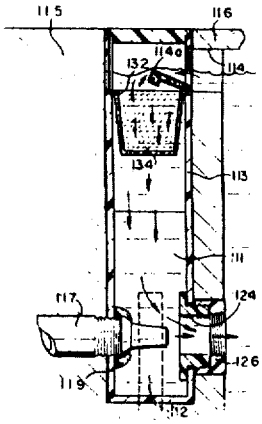

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3 and 13 are determined to be patentable as amended.

Claims 2, 4–12 and 14, dependent on an amended claim, are determined to be patentable.

1. For a swimming pool having a body of water and a water inlet for introducing make-up water into said body to maintain a normal surface level, a skimmer apparatus for collecting solid materials suspended in said body comprising a receiver having an open top and a foraminous portion below said open top, means to support said receiver with its open top adjacent the surface level of the body of water, a receptacle *providing a chamber beyond and* in fluid communication with said foraminous portion of said receiver *and with said open top through said foraminous portion*, means defining a discharge opening in said receptacle *chamber* for directing water from said receptacle into the body of water, and nozzle means adapted to be connected to said water inlet and positioned in registry with said discharge opening to direct a stream of the make-up water from the inlet through said discharge opening, said opening being sufficiently larger than said nozzle stream to cause said nozzle to eject *pool* water from said receptacle *chamber* through said outlet along with the make-up water, the ejection of *pool* water from said receptacle *chamber* causing pool water to flow into the open top of said receiver and through the foraminous portion, solid material in the pool water being trapped in said [receptacle by] *receiver above* said foraminous portion.

3. A skimmer apparatus according to claim 1 wherein said receptacle is tubular in form and is open at the top below the surface of the body, and said receiver having the foraminous portion removably mounted [therein] *in said open top of the receptacle* to afford displacement of said portion to enable emptying solid material trapped therein.

13. In combination with a swimming pool having a rigid wall for containing a body of water and a water inlet for introducing make-up water into said body to maintain a normal surface level, a skimmer apparatus for collecting solid materials suspended in the body of water comprising a receiver having an open top and a foraminous portion below said open top, means to support said receiver with its open top adjacent the surface level of the body of water, a receptacle mounted integrally within said rigid wall *providing a chamber beyond and* in fluid communication with said foraminous portion of said receiver *and with said open top through said foraminous portion,* means defining a discharge opening in said receptacle for directing water from said receptacle *chamber* into said body, said make-up water inlet being positioned within said receptacle to introduce make-up water into the body of water through said receptacle and said discharge opening, and nozzle means connected to said water inlet and positioned in registry with said discharge opening to direct a stream of make-up water from said inlet through said discharge opening, said opening being sufficiently larger than said nozzle stream to cause said nozzle to eject *pool* water from said receptacle *chamber* through said outlet along with the make-up water, the ejection of *pool* water from said receptacle *chamber* causing pool water to flow into the open top of said receiver and through the foraminous portion, solid material in the pool water being trapped in said [receptacle] *receiver* [by] *above* said foraminous portion.

* * * * *